US011577517B2

(12) United States Patent
Yourlo et al.

(10) Patent No.: US 11,577,517 B2
(45) Date of Patent: Feb. 14, 2023

(54) MAINTENANCE SYSTEM USING FOAMING CLEANING BATH

(71) Applicant: Memjet Technology Limited, Dublin (IE)

(72) Inventors: Zhenya Yourlo, North Ryde (AU); Reza Behi, North Ryde (AU)

(73) Assignee: Memjet Technology Limited

( * ) Notice: Subject to any disclaimer, the term of this patent is extended or adjusted under 35 U.S.C. 154(b) by 0 days.

(21) Appl. No.: 17/475,056

(22) Filed: Sep. 14, 2021

(65) Prior Publication Data

US 2022/0088933 A1 Mar. 24, 2022

Related U.S. Application Data

(60) Provisional application No. 63/081,765, filed on Sep. 22, 2020.

(51) Int. Cl.
*B41J 2/165* (2006.01)
*B41J 2/045* (2006.01)

(52) U.S. Cl.
CPC ..... *B41J 2/16552* (2013.01); *B41J 2/04563* (2013.01); *B41J 2/04586* (2013.01); *B41J 2/1652* (2013.01); *B41J 2/16532* (2013.01); *B41J 2/16535* (2013.01); *B41J 2002/16558* (2013.01)

(58) Field of Classification Search
None
See application file for complete search history.

*Primary Examiner* — Alejandro Valencia
(74) *Attorney, Agent, or Firm* — Cooley LLP

(57) ABSTRACT

A printhead maintenance system includes: an inkjet printhead; a carriage movable longitudinally along the printhead in a cleaning direction, the carriage having a maintenance member including: a fluid bath having a mouth opposing the nozzle face of the printhead, a primary fluid inlet at an upstream end of the fluid bath relative to the cleaning direction, a suction nozzle at a downstream end of the fluid bath relative to the cleaning direction and a pair of wipers flanking the fluid bath; and a traversing mechanism for traversing the carriage along the printhead. The maintenance member does not contact inkjet nozzles of the printhead; the wipers each comprise a wiper material for contacting respective parts of the printhead flanking a nozzle face; and the wiper material is air-permeable such that, in use, suction of air through the wiper material into the fluid bath generates a foam in the fluid bath.

15 Claims, 2 Drawing Sheets

MAINTENANCE SYSTEM USING FOAMING CLEANING BATH

CROSS REFERENCE TO RELATED APPLICATIONS

This application claims priority to and the benefit of U.S. Provisional Patent Application No. 63/081,765, entitled PRINTHEAD MAINTENANCE SYSTEM, filed on Sep. 22, 2020, the disclosure of which is incorporated herein by reference in its entirety for all purposes.

FIELD OF THE INVENTION

This invention relates to a maintenance system for inkjet printheads. It has been developed primarily for efficient removal of particulates from printheads, especially pagewide printheads.

BACKGROUND OF THE INVENTION

The Applicant has previously described a number of different maintenance systems for maintaining healthy inkjet nozzles in pagewide printheads. Typically, removal of ink and particulates from a printhead is performed using a wiper.

Wiping may be either longitudinal along a length of the printhead (see, for example, WO 2013/059853) or transversely across the printhead (see, for example, WO 2011/143699). The wiper may be wet or dry, depending to some extent on the characteristics of the ink (e.g. dye-based or pigment-based ink).

Other approaches for removal of particulates from a printhead employ non-contact methods. Non-contact methods typically rely on suction and/or a cleaning fluid, as described in, for example, US 2012/0098886 and U.S. Pat. No. 10,449,769 (the contents of which are incorporated herein by reference). Non-contact methods are suitable for printheads having nozzle plates that are susceptible to damage by shear forces. Non-contact methods are also suitable in situations where a large quantity of particulates comes into contact with the nozzle face. For example, very high-speed printing generates large quantities of paper dust; likewise, 3D printing onto a powder bed generates large quantities of airborne powder, which has a tendency to deposit on the printhead.

Large quantities of particulates on the nozzle face can be removed by conventional wiping techniques; however, the wiper material becomes rapidly clogged with particulates and requires frequent replacement. On the other hand, non-contact methods do not use a wiper material to remove particulates, but tend to be less efficient in removing of the particulates from the nozzle face.

It would be desirable to provide a maintenance system for a printhead, which is suitable for use in high particulate environments (e.g., very high speed printing systems, 3D printing systems etc.). It would further be desirable to provide an improved maintenance system for removing particulates from printheads, whereby a wiping material does not come into contact with the nozzle face.

SUMMARY OF THE INVENTION

In a first aspect, there is provided a printhead maintenance system comprising:

an elongate inkjet printhead having a nozzle face containing a plurality of inkjet nozzles;

a carriage movable longitudinally along the printhead in a cleaning direction, the carriage including a maintenance member comprising: a fluid bath having a mouth opposing the nozzle face of the printhead, a primary fluid inlet at an upstream end of the fluid bath relative to the cleaning direction and a fluid outlet at a downstream end of the fluid bath relative to the cleaning direction; and a traversing mechanism for traversing the carriage longitudinally along the printhead in the cleaning direction, wherein:

the maintenance member does not contact inkjet nozzles of the printhead; and the fluid bath is configured to provide a greater fluid velocity at the downstream end relative to the upstream end.

Preferably, the fluid bath has a nose portion at the upstream end and a tail portion at the downstream end, the nose portion being spaced further from the printhead than the tail portion.

Preferably, the fluid bath configured as an aerofoil in cross-sectional profile.

Preferably, the primary fluid inlet is connected to a cleaning fluid reservoir.

Preferably, the primary fluid inlet is spaced relatively further from the nozzle face than the fluid outlet.

Preferably, the maintenance member comprises a secondary fluid inlet positioned downstream of the fluid outlet relative to the cleaning direction.

Preferably, the primary fluid inlet is positioned relatively further from the nozzle face than the secondary fluid inlet.

Preferably, the secondary fluid inlet and the fluid outlet are spaced at a same distance from the printhead.

Preferably, the fluid bath comprises a transducer for facilitating removal of particulates from the nozzle face.

Preferably, the fluid bath comprises at least one of: a sonicator and an ultrasonicator.

Preferably, the maintenance member has a pair of wipers flanking the fluid bath.

Preferably, the wipers contact respective parts of the printhead flanking the nozzle face, and wherein the respective parts are absent any inkjet nozzles.

Preferably, each wiper comprises an absorbent and air-permeable wiper material.

Preferably, each wiper comprises a replenishable wiping tape.

Preferably, a thickness of the wiper material at least partially determines a distance between the fluid outlet and the nozzle face of the printhead.

Preferably, in use, suction of air through the wiper material into the fluid bath generates a foam in the fluid bath.

Preferably, the primary fluid inlet is connected to a cleaning fluid reservoir containing a cleaning fluid, and wherein the cleaning fluid has a higher surface tension than an ink supplied to the inkjet nozzles of the printhead.

In a second aspect, there is provided a printhead maintenance system comprising:

an elongate inkjet printhead having a nozzle face containing a plurality of inkjet nozzles;

a carriage movable longitudinally along the printhead in a cleaning direction, the carriage including a maintenance member comprising: a fluid bath having a mouth opposing the nozzle face of the printhead, a primary fluid inlet at an upstream end of the fluid bath relative to the cleaning direction; a suction nozzle at a downstream end of the fluid bath relative to the cleaning direction and a pair of wipers flanking the fluid bath; and a traversing mechanism for traversing the carriage longitudinally along the printhead in the cleaning direction, wherein:

the maintenance member does not contact inkjet nozzles of the printhead; and the wipers each comprise a wiper material for contacting respective parts of the printhead flanking the nozzle face; and the wiper material is air-permeable such that, in use, suction of air through the wiper material into the fluid bath generates a foam in the fluid bath.

Preferably, the respective parts of the printhead contacted by the wiper material are absent any inkjet nozzles.

Preferably, the wiper material is a replenishable wiping tape.

Preferably, a thickness of the wiper material at least partially determines a distance between the suction nozzle and the nozzle face of the printhead.

Preferably, the fluid bath is configured to provide a greater fluid velocity at the downstream end relative to the upstream end.

Preferably, the fluid bath has a nose portion at the upstream end and a tail portion at the downstream end, the nose portion being spaced further from the printhead than the tail portion.

Preferably, the fluid bath configured as an aerofoil in cross-sectional profile.

Preferably, the primary fluid inlet is connected to a cleaning fluid reservoir.

Preferably, the primary fluid inlet is spaced relatively further from the nozzle face than the suction nozzle.

Preferably, the maintenance member comprises a secondary fluid inlet positioned downstream of the suction nozzle relative to the cleaning direction.

Preferably, the primary fluid inlet is positioned relatively further from the nozzle face than the secondary fluid inlet.

Preferably, the secondary fluid inlet and the fluid outlet are spaced at a same distance from the printhead.

In a third aspect, there is provided a printhead maintenance system comprising:

an elongate inkjet printhead having a nozzle face containing a plurality of inkjet nozzles for ejecting an ink;

a carriage movable longitudinally along the printhead in a cleaning direction, the carriage including a maintenance member comprising: a primary fluid inlet at an upstream end of the maintenance member relative to the cleaning direction and a fluid outlet downstream of the fluid inlet relative to the cleaning direction;

a cleaning fluid reservoir for supplying a cleaning fluid to the primary fluid inlet; and a traversing mechanism for traversing the carriage longitudinally along the printhead in the cleaning direction, wherein:

the maintenance member does not contact inkjet nozzles of the printhead; and the cleaning fluid has a higher surface tension than the ink.

Preferably, the cleaning fluid comprises an ink vehicle having a lower amount of surfactant than the ink.

Preferably, in use, the cleaning fluid is at a lower temperature than the ink.

Preferably, in use, a thermal regulation system of the printhead raises the temperature of the ink.

Preferably, the thermal regulation system comprises resistive inkjet actuators contained in inkjet nozzle devices.

Preferably, the fluid outlet comprises a suction nozzle connected to a vacuum source.

Preferably, the maintenance member comprises a fluid bath having a mouth opposing the nozzle face of the printhead, the primary fluid inlet being positioned at an upstream end of the fluid bath relative to the cleaning direction and the fluid outlet being positioned at a downstream end of the fluid bath relative to the cleaning direction.

Preferably, the fluid bath is configured to provide a greater fluid velocity at the downstream end relative to the upstream end.

Preferably, the primary fluid inlet is spaced relatively further from the nozzle face than the fluid outlet.

Preferably, the maintenance member comprises a secondary fluid inlet positioned downstream of the fluid outlet relative to the cleaning direction.

Preferably, the primary fluid inlet is positioned relatively further from the nozzle face than the secondary fluid inlet.

Preferably, the secondary fluid inlet and the fluid outlet are spaced at a same distance from the printhead.

Preferably, the maintenance member has a pair of wipers flanking the fluid bath.

Preferably, the wipers contact respective parts of the printhead flanking the nozzle face, and wherein the respective parts are absent any inkjet nozzles.

Preferably, in use, suction of air through the wiper material into the fluid bath generates a foam in the fluid bath.

As used herein, the term "mounted" includes both direct mounting and indirect mounting via an intervening part.

As used herein, the term "ink" refers to any ejectable fluid and may include, for example, conventional CMYK inks (e.g. pigment and dye-based inks), infrared inks, UV-curable inks, fixatives, primers, binders, 3D printing fluids, polymers, biological fluids etc. The present invention is particularly suitable for use in high particulate environments such as 3D printers and, accordingly, the term "ink" explicitly includes any ejectable fluid used in 3D printing applications.

BRIEF DESCRIPTION OF THE DRAWINGS

Specific embodiments of the present invention will now be described by way of example only with reference to the accompanying drawings, in which:—

DETAILED DESCRIPTION OF THE INVENTION

Figure 1:
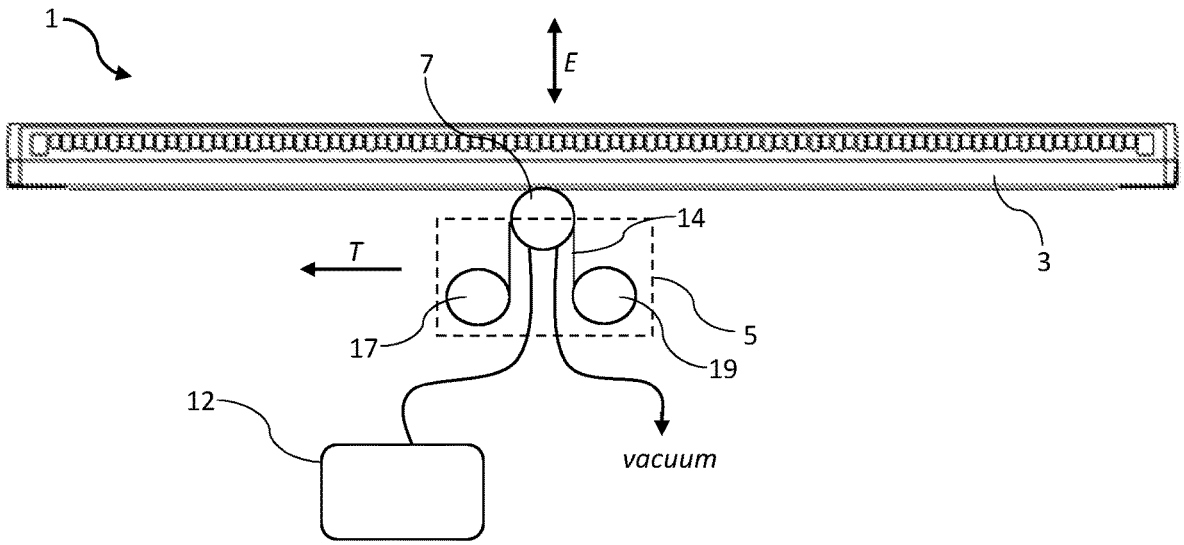
FIG. 1 is a schematic side view of a printhead maintenance system.
Figure 2:
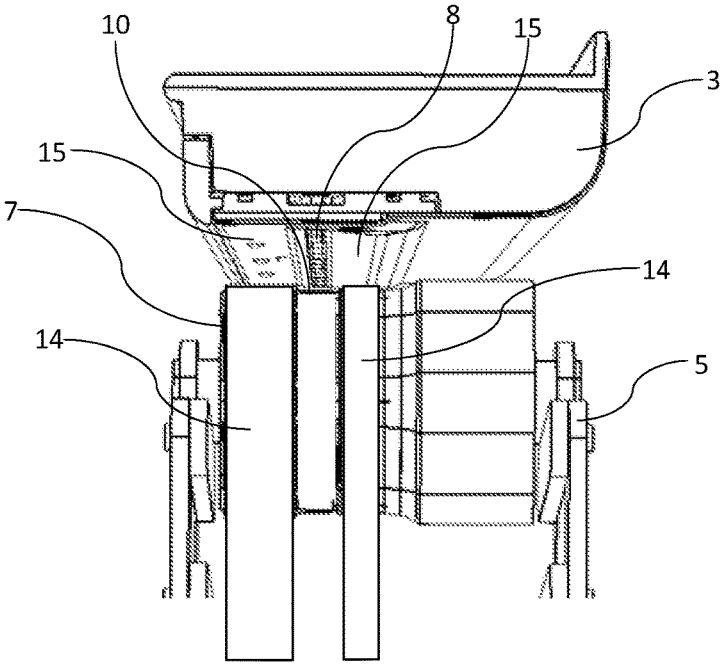
FIG. 2 is an end view of the printhead maintenance system.

Referring to FIGS. 1 to 4, there is shown a printhead maintenance system 1 for maintaining an elongate inkjet printhead 3, such as a pagewide printhead. The maintenance system comprises a carriage 5, which is movable longitudinally along the printhead 3 in a cleaning direction by means of a suitable traversing mechanism indicated schematically by arrow T. In FIG. 1, the carriage 5 is shown about halfway through a maintenance operation traversing from right-to-left as shown.

A maintenance member 7 is mounted on the carriage 5 for operably maintaining inkjet nozzles in a nozzle face 8 of the printhead 3. The printhead 3 is operatively connected to an engagement mechanism, indicated schematically by double-headed arrow E, for reciprocally lifting and lowering the printhead relative to the maintenance member 7. In FIG. 1, the printhead 3 is shown in a lowered, engaged position.

Various traversing and engagement mechanisms will be well known to the person skilled in the art. For example, the traversing mechanism may comprise a lead screw engaged with the carriage 5 for traversing the carriage along the length of the printhead 3. The engagement mechanism may comprise a rack-and-pinion mechanism or a scissor mechanism for lifting and lowering the printhead 3 relative to the carriage 5. Such mechanisms are well within the ambit of the person skilled in the art and will not be described in further detail herein.

The maintenance member 7 is of the type that does not make contact with the nozzle face 8 of the printhead 3. Rather than removing ink and particulates from the nozzle face 8 via contact wiping, the maintenance member has 7 a maintenance face 10 opposing the nozzle face 8 and spaced apart therefrom.

The maintenance member 7 is connected to a cleaning fluid reservoir 12, which delivers a cleaning fluid to the maintenance face 10, and a vacuum source, which applies suction to the maintenance face. Although the maintenance face 10 of the maintenance member 7 makes no contact with the nozzle face 8 of the printhead 3, webs of absorbent wiper material 14 (in the form of microfibre tape) positioned at either side of the maintenance face 10 make contact with non-printing regions 15 of the printhead 3 for wiping away ink and particulates from these regions at either side of the nozzle face. The thickness of the wiper material 14 controls, at least to some extent, a separation between the maintenance face 10 and the nozzle face 8 of the printhead. The pair of microfibre tapes 14 may be supplied from a supply spool 17 and wound onto a take-up spool 19 in the carriage 5. In this way, the wiper material 14 is replenishable such that soiled portions can be refreshed with clean portions periodically, as required. Other arrangements for providing replenishable wiper material will be well known to the person skilled in the art. For example, the wiper material 14 may be supplied from respective pleated stacks in order to maximize available space in the carriage 5.

Several features of the maintenance member 7 make it especially suitable for efficient removal of ink and particulates from the nozzle face 8, in contrast with known maintenance systems using cleaning fluid and suction. These features will now be described in detail with reference to FIGS. 3 and 4.

Figure 3:
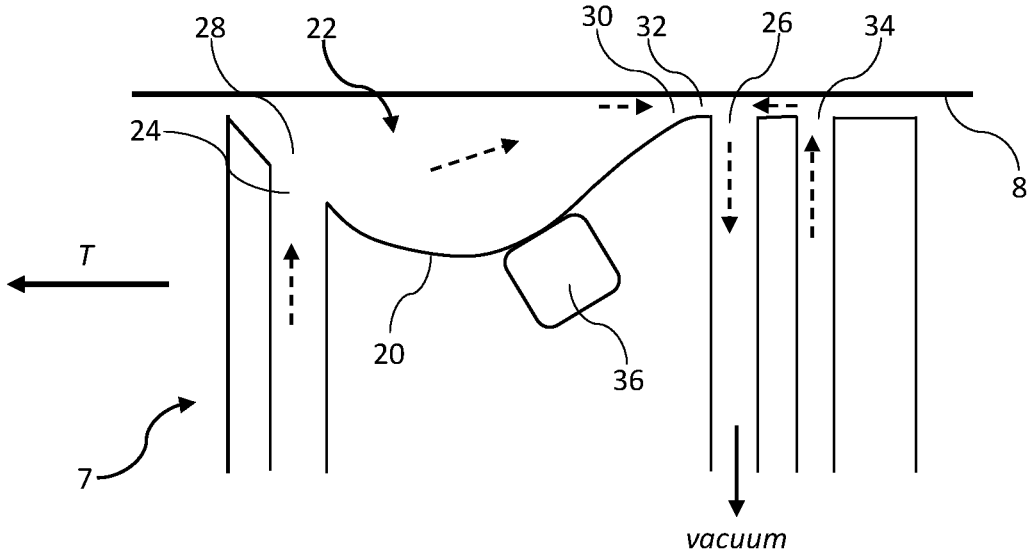
FIG. 3 is a cross-sectional view of a maintenance member.

Firstly, and referring to FIG. 3, the maintenance member 7 comprises a fluid bath 20 having a mouth 22 opposing the nozzle face 8, which is configured to encourage removal of particulates. During maintenance, the maintenance member 7 is moved lengthwise along the printhead in a longitudinal cleaning direction indicated by arrow T. A primary fluid inlet 24, connected to the cleaning fluid reservoir 12, is positioned at an upstream end of the fluid bath 20 relative to the cleaning direction and a fluid outlet in the form of a suction nozzle 26 is positioned at a downstream end of the fluid bath relative to the cleaning direction. The primary fluid inlet 24 is angled so as to encourage fluid flow in a direction generally opposite to the cleaning direction. Additionally, the fluid bath 20 is profiled to provide a greater fluid velocity at its downstream end relative to its upstream end. This is by virtue of an aerofoil profile, whereby a nose portion 28 of the fluid bath 20 containing the fluid inlet 24 is spaced further from the nozzle face 9 than a tail portion 30 containing the suction nozzle 26. With the fluid bath 20 configured in this way, the cleaning fluid has a maximum velocity through a restriction 32 adjacent and upstream of the suction nozzle 26 by virtue of the Bernoulli effect. By maximizing the velocity of the cleaning fluid adjacent the nozzle face 8, removal of particulates from the nozzle face is maximized via dislodgement and entrainment of the particulates in the fluid flow (indicated by dashed arrows in FIG. 3).

During wiping, ink supplied to the printhead 3 may be positively pressurized by an ink delivery system (not shown) in order to purge ink from the nozzles and avoid ingestion of cleaning fluid into the nozzles. Suitable ink delivery systems for controlling ink pressure in the printhead 3 are described in, for example, U.S. Pat. No. 10,252,540, the contents of which are incorporated herein by reference.

A secondary fluid inlet 34, connected to the cleaning fluid reservoir 12, is positioned downstream of the suction nozzle 26 relative to the cleaning direction. The secondary fluid inlet 34 functions to provide a fluidic seal at the downstream end of the maintenance face 10, while a meniscus seal at the upstream end of the maintenance face minimize leakages from the fluid bath 20.

In order to further maximize removal of particulates from the nozzle face 8, the fluid bath may be provided with a transducer 36, such as an ultrasonicator. Sonicators and ultrasonicators are well known in the art for agitating fluids and dislodging particulates.

Figure 4:
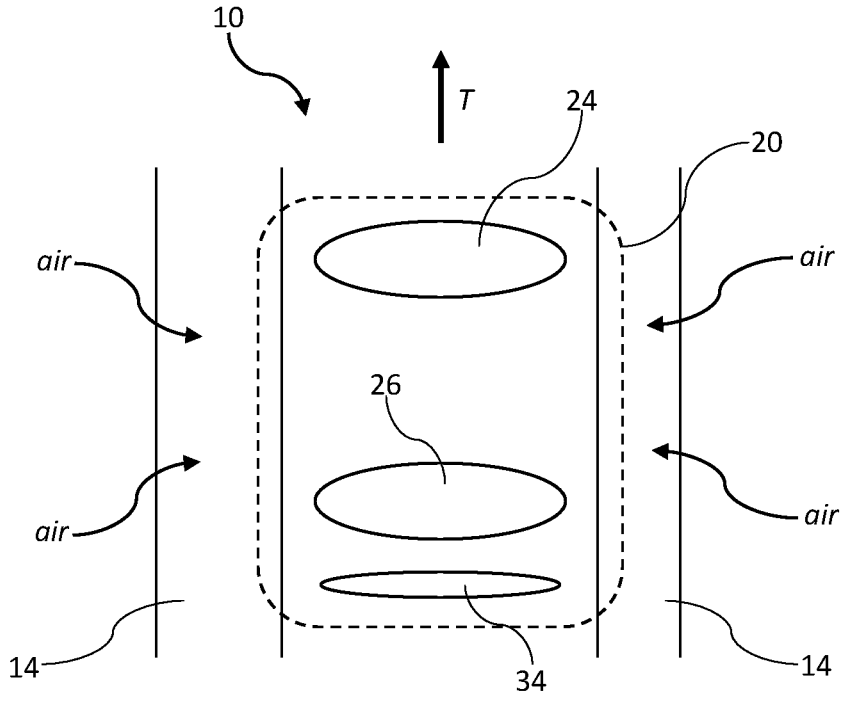
FIG. 4 is a plan view of a maintenance face of the maintenance member.

As best seen in FIG. 4, a pair of microfibre wiping tapes 14 laterally flank the fluid bath 20 relative to the cleaning direction T. The wiping tape 14 is porous allowing the ingress of air into the fluid bath 20 via suction through the suction nozzle 26. Since air is sucked into the fluid bath 20 via a porous membrane, bubbles enter fluid bath and generate a liquid foam therein. An extent of foaming may be controlled via suitable selection of pore size in the wiping tape 14. As described in U.S. Pat. No. 7,581,852, the contents of which are incorporated herein by reference, a liquid foam is highly effective for removal and entrainment of particulates due to attractive forces at vertices between Voronoi polyhedra in the foam. Accordingly, the combination of a high fluid velocity together with foaming in the fluid bath 20 provides highly effective removal of particulates.

Further optimization of the efficiency of the printhead maintenance system 1 may be achieved by formulating the cleaning fluid so as to have a higher surface tension than ink supplied to printhead 3. This difference in surface tensions will tend to draw ink away from the nozzle face 8 towards the cleaning fluid contained in the fluid bath 20 via the well-known Marangoni effect. For example, the cleaning fluid may comprise an ink vehicle (which is absent any colorant, binder etc.) having a lower amount of surfactant than the ink supplied to the printhead 3.

Furthermore, ensuring the cleaning fluid is at a lower temperature than the ink further encourages the flow of ink and entrained particulates into the fluid bath 20. This may be achieved either by raising the temperature of the ink (e.g. using resistive inkjet actuators as part of a printhead thermal regulation system) and/or lowering the temperature of the cleaning fluid (e.g. by refrigerating the cleaning fluid reservoir 12 or passing the cleaning fluid through a cooling system en route to the maintenance member 7).

From the foregoing, it will be appreciated that there the printhead maintenance system 1 is suitable for use in high particulate environments. Such a maintenance system is especially useful for 3D printing systems, whereby a binder fluid ejected from the printhead onto a powder bed generates large quantities of particulates in the print zone.

It will, of course, be appreciated that the present invention has been described by way of example only and that modifications of detail may be made within the scope of the invention, which is defined in the accompanying claims.

The invention claimed is:

1. A printhead maintenance system comprising:

an elongate inkjet printhead having a nozzle face containing a plurality of inkjet nozzles;

a carriage movable longitudinally along the printhead in a cleaning direction, the carriage including a maintenance member comprising: a fluid bath having a mouth opposing the nozzle face of the printhead, a primary fluid inlet at an upstream end of the fluid bath relative to the cleaning direction, a suction nozzle at a downstream end of the fluid bath relative to the cleaning direction and a pair of wipers flanking the fluid bath; and a traversing mechanism for traversing the carriage longitudinally along the printhead in the cleaning direction, wherein:

the maintenance member does not contact inkjet nozzles of the printhead;

the wipers each comprise a wiper material for contacting respective parts of the printhead flanking the nozzle face; and the wiper material is air-permeable such that, in use, suction of air through the wiper material into the fluid bath generates a foam in the fluid bath.

2. The maintenance of system of claim 1, wherein the respective parts of the printhead contacted by the wiper material are absent any inkjet nozzles.

3. The maintenance system of claim 1, wherein the wiper material is a replenishable wiping tape.

4. The maintenance system of claim 1, wherein a thickness of the wiper material at least partially determines a distance between the suction nozzle and the nozzle face of the printhead.

5. The maintenance system of claim 1, wherein the fluid bath is configured to provide a greater fluid velocity at the downstream end relative to the upstream end.

6. The maintenance system of claim 1, wherein the fluid bath has a nose portion at the upstream end and a tail portion at the downstream end, the nose portion being spaced further from the printhead than the tail portion.

7. The maintenance system of claim 6, wherein the fluid bath configured as an aerofoil in cross-sectional profile.

8. The maintenance system of claim 1, wherein the primary fluid inlet is connected to a cleaning fluid reservoir.

9. The maintenance system of claim 1, wherein the primary fluid inlet is spaced relatively further from the nozzle face than the suction nozzle.

10. The maintenance system of claim 1, wherein the maintenance member comprises a secondary fluid inlet positioned downstream of the suction nozzle relative to the cleaning direction.

11. The maintenance system of claim 10, wherein the primary fluid inlet is positioned relatively further from the nozzle face than the secondary fluid inlet.

12. The maintenance system of claim 11, wherein the secondary fluid inlet and the fluid outlet are spaced at a same distance from the printhead.

13. The maintenance system of claim 1, wherein the fluid bath comprises a transducer for facilitating removal of particulates from the nozzle face.

14. The maintenance system of claim 13, wherein the fluid bath comprises at least one of: a sonicator and an ultrasonicator.

15. The maintenance system of claim 1, wherein the primary fluid inlet is connected to a cleaning fluid reservoir containing a cleaning fluid, and wherein the cleaning fluid has a higher surface tension than an ink supplied to the inkjet nozzles of the printhead.

* * * * *